US008277259B2

(12) United States Patent
Hattori et al.

(10) Patent No.: US 8,277,259 B2
(45) Date of Patent: Oct. 2, 2012

(54) CONNECTOR

(75) Inventors: Takashi Hattori, Tokai-mura (JP); Sachio Suzuki, Hitachi (JP); Hideaki Takehara, Hitachi (JP); Kunihiro Fukuda, Tsukuba (JP); Yuta Kataoka, Hitachi (JP); Jun Umetsu, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 13/137,029

(22) Filed: Jul. 15, 2011

(65) Prior Publication Data

US 2012/0077360 A1 Mar. 29, 2012

(30) Foreign Application Priority Data

Sep. 28, 2010 (JP) ..... 2010-217419

(51) Int. Cl.
*H01R 24/00* (2011.01)

(52) U.S. Cl. ..... 439/660

(58) Field of Classification Search ..... 439/660, 439/353, 74, 541.5; 174/88 B
See application file for complete search history.

(56) References Cited

U.S. PATENT DOCUMENTS 3,504,100 A * 3/1970 Ohshima Keiji et al. ... 174/88 B
3,614,297 A * 10/1971 Carlson ..... 174/88 B
5,967,850 A * 10/1999 Crane, Jr. ..... 439/660
6,183,314 B1 * 2/2001 Wada et al. ..... 439/752
7,189,120 B2 * 3/2007 Zaderej ..... 439/660
7,367,816 B2 * 5/2008 Liu ..... 439/74
7,794,247 B2 9/2010 Suzuki
2009/0075506 A1 3/2009 Suzuki

FOREIGN PATENT DOCUMENTS

JP 2004-56924 A 2/2004
JP 4037199 B2 11/2007
JP 2009-70754 A 4/2009

* cited by examiner

*Primary Examiner* — Phuong Dinh
(74) *Attorney, Agent, or Firm* — McGinn IP Law Group, PLLC

(57) ABSTRACT

A connector includes a first terminal housing with a plurality of first joining terminals aligned and accommodated therein, a second terminal housing with a plurality of second joining terminals aligned and accommodated therein, a connecting member for pressing and thereby collectively fixing the plural first joining terminals and the plural second joining terminals at the contacts therebetween respectively, and a covering member slidably provided to cover the connecting member, to maintain the pressing force of the pressed connecting member at a specified or greater pressing force that assures the stable connections between the first joining terminals and the second joining terminals, respectively, the covering member being provided in such a manner that it is not slidable to cover the connecting member until the pressing force of the connecting member reaches the pressing force that assures the stable connections between the first joining terminals and the second joining terminals, respectively.

6 Claims, 7 Drawing Sheets

4a-4c FIRST JOINING TERMINAL
6a-6c FIRST JOINING TERMINAL
8a-8d ISOLATING MEMBER
9 CONNECTING MEMBER

61 COVERING MEMBER
62 COVERING MEMBER INSERTION HOLE
63 HANDLE

CONNECTOR

The present application is based on Japanese patent application No. 2010-217419 filed on Sep. 28, 2010, the entire contents of which are incorporated herein by reference.

BACKGROUND OF THE INVENTION

1. Field of the Invention

This invention relates to a connector, for use in eco-friendly cars, such as hybrid vehicles, electric vehicles and the like, and in particular, for being capable of use for a portion to connect a power harness, which is used for large power transmission.

2. Description of the Related Art

In hybrid vehicles, electric vehicles and the like which have remarkably developed in recent years, a power harness, which is used for large power transmission for connection between devices, has at its one end a connector, which consists of two separate portions: a male connector portion with a male terminal and a first terminal housing accommodating that male terminal; and a female connector portion with a female terminal connected with the male terminal and a second terminal housing accommodating that female terminal (Refer to JP-A-2009-070754, for example).

In recent years, such eco-friendly cars have been designed to reduce the weights of all parts thereof, to enhance the energy saving performance of the cars. As one effective means to reduce the weights of parts of the cars, it has been proposed to reduce the sizes of the parts.

For example, a technique as described below, which has been disclosed by JP Patent No. 4037199, is known in the art.

JP Patent No. 4037199 discloses an electrical connection structure for a vehicle, which is for connecting multiphase conductive member joining terminals drawn out from a motor for driving the vehicle, and multiphase power line cable joining terminals drawn out from an inverter for driving the motor. The technique used in the electrical connection structure disclosed by JP Patent No. 4037199 is as follows. Each phase joining terminal of the conductive member and each corresponding phase joining terminal of the power line cable are overlapped, and isolating members are disposed on opposite surfaces to the overlapped surfaces of the joining terminals, respectively, and these overlapped joining terminals and isolating members are collectively fastened in an overlapping direction (also referred to as stacking direction) with a single bolt provided in a position to penetrate these overlapped joining terminals and isolating members.

That is, in the technique used in the electrical connection structure disclosed by JP Patent No. 4037199, the single bolt is tightened in the overlapping direction (stacking direction), to collectively hold the multiplicity of contacts between the joining terminals, which are the overlapped surfaces of the joining terminals, and thereby fix the joining terminals at the contacts therebetween, for electrical connections between the joining terminals, respectively. Such configuration as disclosed by JP Patent No. 4037199 is effective in easily ensuring size reduction, compared to the technique disclosed by JP-A-2009-070754.

Further, the technique disclosed by JP Patent No. 4037199 allows its structure to hold, with a holding jig separately provided therein, the isolating members between which the contacts between the joining terminals respectively are sandwiched, and thereby hold the pitch between the isolating members. Such configuration as disclosed by JP Patent No. 4037199 is effective for the insertability/removability of the joining terminals.

Refer to JP-A-2009-070754 and JP Patent No. 4037199, for example.

SUMMARY OF THE INVENTION

However, when applied to the vehicle connector having the terminal housings, the technique used in the electrical connection structure disclosed by JP Patent No. 4037199 has the following drawbacks.

In view of the vibration problem due to use on the vehicle, the bolt may loosen due to the vibration, the pressing force at the respective contacts between the joining terminals may decrease, and the joining terminals may tend to slightly slide relative to each other.

Also, in order to ensure the prevention of the slight sliding of the joining terminals relative to each other or the respective stable connections between the joining terminals, the bolt needs to be fully tightened to apply the sufficient pressing force to the contacts, and it is therefore necessary to detect whether the tightening of the bolt is complete or not. However, because of no equipment of any means capable of detecting the degree of the tightening of the bolt, there is the problem that the skilled worker has to check each and every time whether the tightening of the bolt is complete or not.

Accordingly, it is an object of the present invention to provide a connector, which is a stacked structure type connector, capable of suppressing the decrease in the pressing force at its contacts due to vibration, and of easily detecting whether the tightening of the connecting member is complete or not.

(1) According to One Embodiment of the Invention, a Connector Comprises:

a first terminal housing with a plurality of first joining terminals aligned and accommodated therein;

a second terminal housing with a plurality of second joining terminals aligned and accommodated therein;

a stacked connection structure that, when the first terminal housing and the second terminal housing are mated together, the plural first connecting terminals and the plural second connecting terminals face each other to form pairs, respectively, and the isolating plates, the first connecting terminals and the second connecting terminals are disposed alternately;

a plurality of isolating members aligned and accommodated in the first terminal housing, the plural isolating members being disposed on other surfaces of the plural first joining terminals, respectively;

a connecting member for pressing and thereby collectively fixing the plural first joining terminals and the plural second joining terminals at the contacts therebetween respectively, to electrically connect the first joining terminals and the second joining terminals, respectively; and a covering member slidably provided to cover the connecting member, to maintain the pressing force of the pressed connecting member at a specified or greater pressing force that assures the stable connections between the first joining terminals and the second joining terminals, respectively, the covering member being provided in such a manner that it is not slidable to cover the connecting member until the pressing force of the connecting member reaches the pressing force that assures the stable connections between the first joining terminals and the second joining terminals, respectively.

In the above embodiment (1) of the invention, the following modifications and changes can be made.

(i) The connecting member comprises a head shaped into a polygon having an even number of sides, and the covering member comprises an engaging groove which is engaged onto the head of the connecting member.

(ii) The covering member comprises a protruding portion in a sliding direction thereof, and the connecting member comprises an engaging groove into which the protruding portion is engaged.

(iii) The first terminal housing is a male terminal housing, the second terminal housing is a female terminal housing, and the covering member is slidably inserted to fill the gap between the second terminal housing and the pressed connecting member.

(iv) The covering member comprises a visible light transparent material.

(v) The covering member comprises a visible light opaque material.

Points of the Invention

According to one embodiment of the invention, a connector is constructed such that a covering member thereof has both the function of preventing the loosening of a connecting member to maintain the pressing force of the connecting member at a specified or greater pressing force, and the function of detecting the incomplete tightening of the connecting member to detect whether the tightening of the connecting member is complete or not. Therefore, it is possible to prevent a decrease in the pressing force at electrical contacts that may be caused by vibrations and to easily detect whether the tightening of the connecting member is complete or not.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described a preferred embodiment according to the invention, in conjunction with the accompanying drawings.

Figure 1:
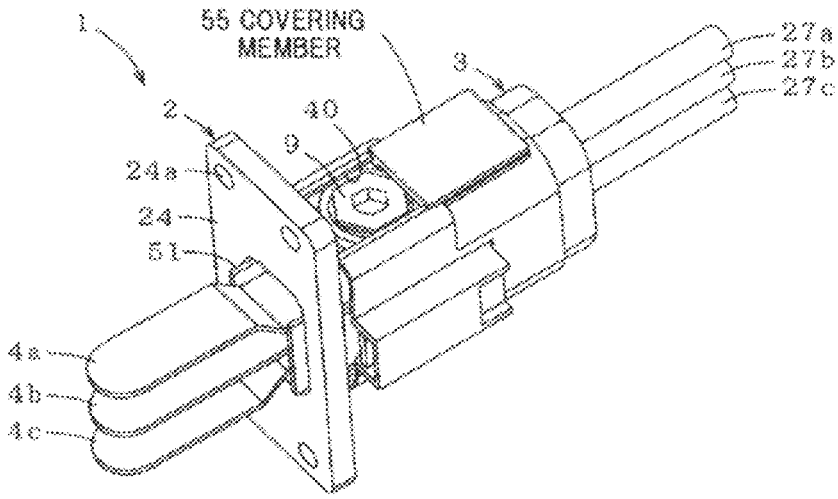
FIG. 1 is a perspective view showing a connector in one embodiment according to the invention.
Figure 2:
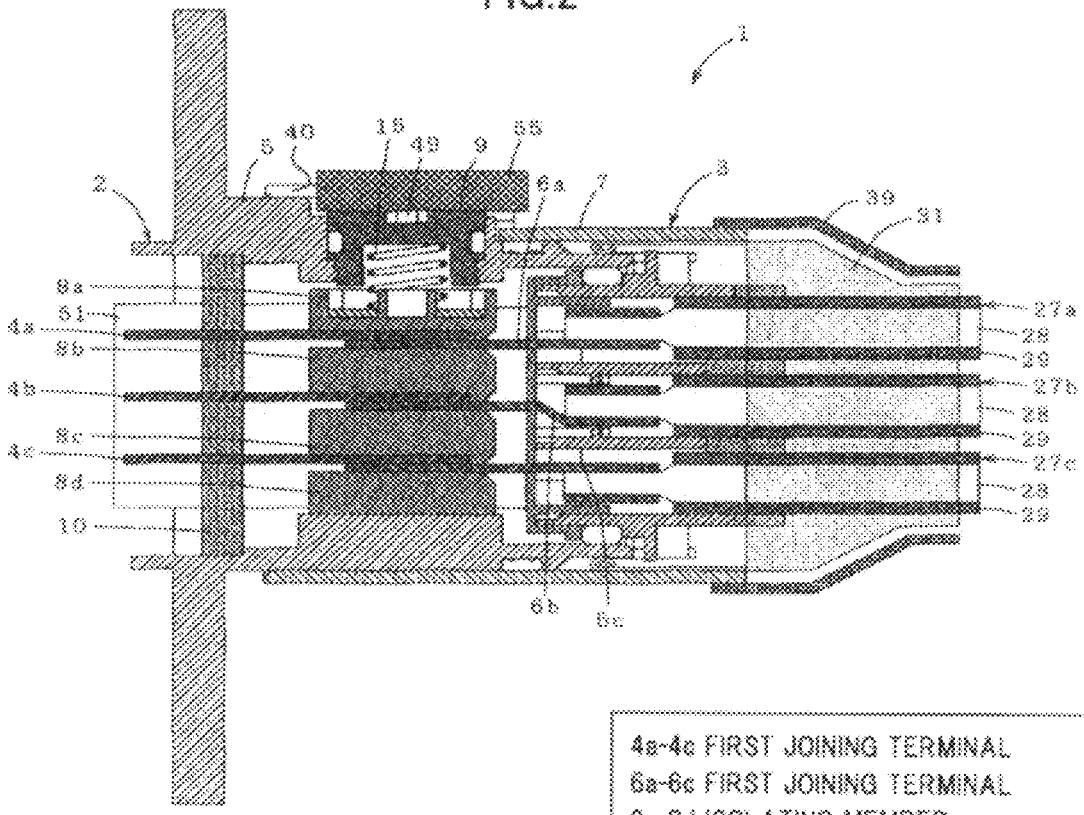
FIG. 2 is a cross sectional view showing the connector in one embodiment according to the invention.

FIG. 1 is a perspective view showing a connector 1 in the preferred embodiment according to the invention, and FIG. 2 is a cross sectional view showing the connector 1. Incidentally, in FIG. 1, a later described braided shield 31 and a later described rubber boot 39 are omitted. Also, in FIG. 2, first joining terminals 4*a* to 4*c* are depicted as being simplified in shape (cf. FIG. 1, likewise FIGS. 3 and 16).

Connector 1 Structure

As shown in FIGS. 1 and 2, the connector 1 in this embodiment is constructed of a first connector portion 2 and a second connector portion 3, which are mated together, to thereby collectively connect a plurality of power lines.

More specifically, the connector 1 includes the first connector portion 2 having a first terminal housing 5 with a plurality of (three) first joining terminals (male terminals) 4*a* to 4*c* aligned and accommodated therein, and the second connector portion 3 having a second terminal housing 7 with a plurality of (three) second joining terminals (female terminals) 6*a* to 6*c* aligned and accommodated therein. When the first connector portion 2 and the second connector portion 3 are mated together, the plural first joining terminals 4*a* to 4*c* and the plural second joining terminals 6*a* to 6*c* face each other to form pairs, respectively, at one surface thereof, and result in a stacked structure comprising the first joining terminals 4*a* to 4*c* and the second joining terminals 6*a* to 6*c* alternately disposed therein.

This connector 1 is used for connection of a vehicle drive motor and an inverter for diving that motor, for example.

More specifically, the first terminal housing 5 of the first connector portion 2 (in FIG. 1, left side portion) is mated with a shield case of the motor, and the first joining terminal 4*a* to 4*c* portions exposed from the first terminal housing 5 are connected to terminals, respectively, of a terminal block installed in the shield case of the motor. Mating to this first connector portion 2 the second connector portion 3 electrically connected with the inverter results in electrical connection of the motor and the inverter. Although the foregoing is concerned with the motor side connection, the same applies to the inverter side connection.

First and Second Connector Portions 2 and 3

Below are described the respective specific structures of the first connector portion 2 and the second connector portion 3.

First Connector Portion 2

Figure 3:
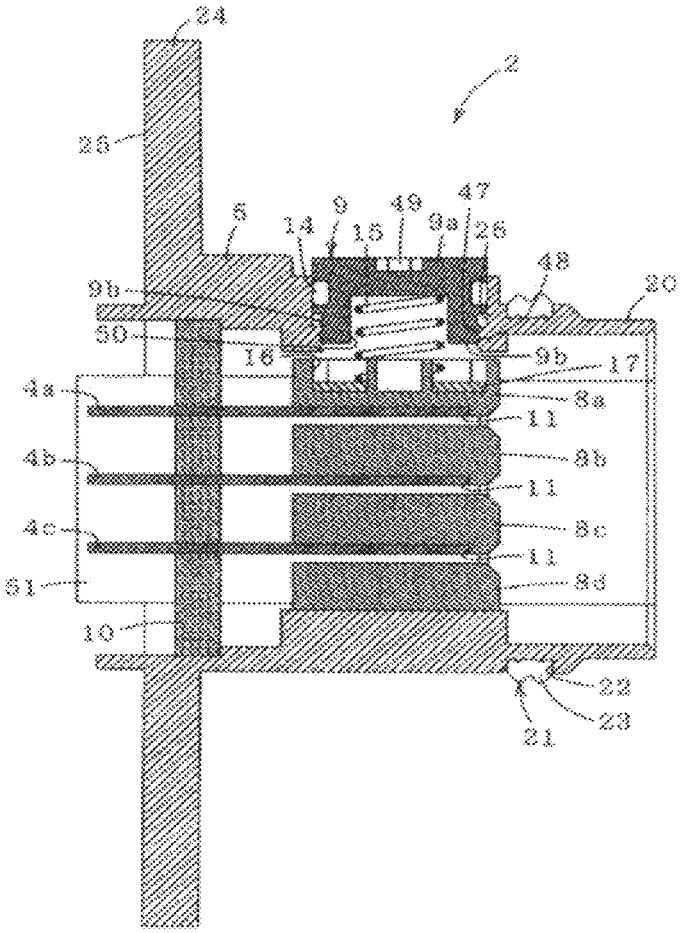
FIG. 3 is a cross sectional view showing a first connector portion.

Referring to FIG. 3, the first connector portion 2 has the three first joining terminals 4*a* to 4*c* held therein to be aligned at a specified pitch, and includes the first terminal housing 5 for accommodating the three aligned first joining terminals 4*a* to 4*c*, a plurality of substantially rectangular parallelepiped isolating members 8*a* to 8*d* provided in the first terminal housing 5 for isolating each of the first joining terminals 4*a* to 4*c*, and a connecting member 9 for pressing the adjacent isolating member 8*a*, and thereby collectively fixing the plural first joining terminals 4*a* to 4*c* and the plural second joining terminals 6*a* to 6*c* at the contacts therebetween, for electrical connections between the plural first joining terminals 4*a* to 4*c* and the plural second joining terminals 6*a* to 6*c*, respectively.

Incidentally, the first terminal housing 5 may be a male (male housing) or a female (female housing). Herein, the first terminal housing 5 is described as being a male housing as one example.

First Joining Terminals 4*a* to 4*c*

The first joining terminals 4*a* to 4*c* are plate terminals, and are held to be spaced apart from each other and aligned at a predetermined pitch by a first inner housing 10 comprising a molded resin body accommodated within the first terminal housing 5 and formed of a non-conductive resin (e.g. PPS (polyphenylene sulfide) resin, PPA (polyphthalamide) resin, PA (polyamide) resin, PBT (polybutylene terephthalate), epoxy based resin). A method to hold the first joining terminals 4*a* to 4*c* to the first inner housing 10 is to insert the first joining terminals 4*a* to 4*c* thereinto during molding of the first inner housing 10 and then cure the resin, thereby holding them thereto, or to press the first joining terminals 4*a* to 4*c* into the pre-molded first inner housing 10, thereby holding them thereto.

The first joining terminals 4*a* to 4*c* are fed with electricity at different voltages and/or currents, respectively. For example, in this embodiment, power lines are assumed to be for three phase alternating current between a motor and an inverter, so that the first joining terminals 4*a* to 4*c* are fed with alternating currents, respectively, which are 120 degrees out of phase with each other. For the purpose of reducing the loss of power transmitted through the connector 1, the first joining terminals 4*a* to 4*c* may each be formed of a metal such as a high conductivity silver, copper, aluminum, or the like. Also, the first joining terminals 4*a* to 4*c* each have slight flexibility.

Also, the first joining terminals 4*a* to 4*c* are fixed integrally with the isolating members 8*a* to 8*c* disposed adjacent to their other surfaces (i.e. to the opposite surfaces to the surfaces joined with the second joining terminals 6*a* to 6*c*) respectively. That is, as described above, the first joining terminals 4*a* to 4*c* are held to be spaced apart from each other and aligned at a predetermined pitch by the first inner housing 10, and fixed integrally with the isolating members 8*a* to 8*c* at tips respectively thereof, therefore resulting in the isolating members 8*a* to 8*c* being also aligned at a specified pitch. This configuration ensures the insulating property between the respective contacts of the first joining terminals 4*a* to 4*c* and the second joining terminals 6*a* to 6*c*, and the insertability of the mating second joining terminals 6*a* to 6*c*.

Isolating Members 8*a* to 8*d*

The plural isolating members 8*a* to 8*d* comprise the plurality of first isolating members 8*a* to 8*c* aligned and accommodated in the first terminal housing 5, and fixed to the other surfaces of the plural first joining terminals 4*a* to 4*c* (i.e. to the opposite surfaces to the surfaces joined with the second joining terminals 6*a* to 6*c*) respectively, and the second isolating member 8*d* provided to be fixed to an inner surface of the first terminal housing 5, and to face the other surface of the second joining terminal 6*c* (i.e. the opposite surface to the surface joined with the first joining terminal 4*c*) positioned at the outermost side when stacking the plural first joining terminals 4*a* to 4*c* and the plural second joining terminals 6*a* to 6*c*.

Figure 4A:
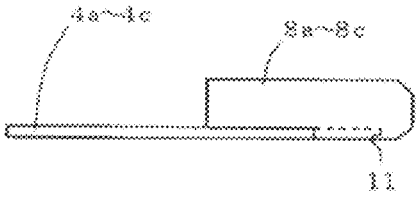
FIGS. 4A and 4B are a side view and a bottom view, respectively, showing a first joining terminal.
Figure 4B:
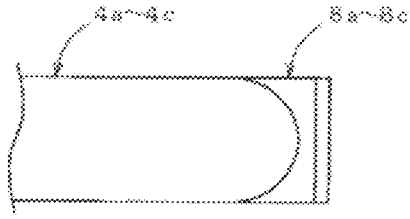

The plural isolating members 8*a* to 8*d* are fixed at such a position as to protrude from the tips of the first joining terminals 4*a* to 4*c*. Each of these isolating members 8*a* to 8*d* is chamfered at each of its corners on the second joining terminal 6*a* to 6*c* inserting/removing side. Also, referring to FIGS. 4A and 4B, each of the plural first isolating member 8*a* to 8*c* surfaces to be fixed to the first joining terminals 4*a* to 4*c* is formed with a mating groove 11 for mating onto the first joining terminals 4*a* to 4*c* to be fixed. The first joining terminals 4*a* to 4*c* to be fixed are mated into these mating grooves 11, thereby being fixed integrally with the first isolating members 8*a* to 8*c*, respectively. This results in filling of the level differences between the first isolating members 8*a* to 8*c* and the first joining terminals 4*a* to 4*c* respectively, so that the lower surfaces (in the figure, the lower surfaces) of the first isolating members 8*a* to 8*c* are coplanar with the lower surfaces (in the figure, the lower surfaces) of the first joining terminals 4*a* to 4*c*, respectively. This configuration allows enhancing the insertability/removability of the second joining terminals 6*a* to 6*c* onto the first joining terminals 4*a* to 4*c*, respectively, when the first connector portion 2 and the second connector portion 3 are mated together. Incidentally, in FIG. 4A, the structure of the first isolating member 8*a* is depicted as being simplified, and the first isolating members 8*a* to 8*c* are depicted likewise.

Connecting Member 9

Figure 5:
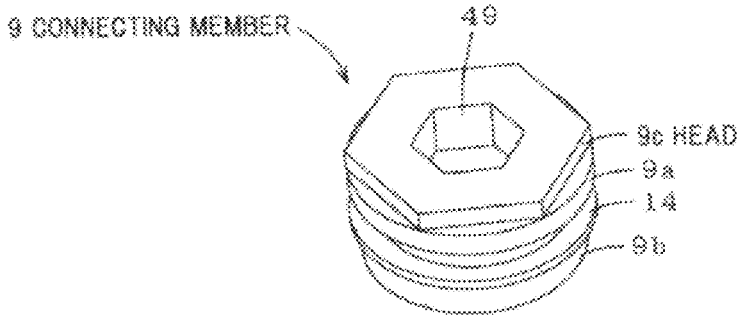
FIG. 5 is a perspective view showing a connecting member.

Referring to FIG. 5, the connecting member 9 is a non-penetrating connecting member made of a metal (e.g. SUS, iron, copper alloy, or the like), and having a large diameter portion 9*a*, and a small diameter portion 9*b* formed integrally with the large diameter portion 9*a*.

The large diameter portion 9*a* is provided with a packing 14 therearound for preventing water from penetrating into the first terminal housing 5.

Also, a head 9*c* on top of the large diameter portion 9*a* is formed in a polygonal shape having an even number of sides, such as a square, hexagon, octagon or the like, or in FIG. 5, a hexagonal shape. An upper surface of this head 9*c* is formed with an odd shaped hole (in FIG. 5, a hexagonal hole) 49, so that the connecting member 9 may be rotated and tightened by mating a tightening tool, such as a spanner, into that odd shaped hole 49.

Referring again to FIG. 3, an outer surface of the small diameter portion 9*b* is formed with a male screw 48 which is screwed into a female screw 47 formed in an inner surface of a connecting member insertion hole 26 of the first terminal housing 5. This configuration results in the connecting member 9 being configured to be screwed into the first terminal housing 5, and thereby press the adjacent first isolating member 8*a*.

Also, the connecting member 9 is shaped to have the two diameter dimensions, i.e. the large diameter portion 9*a* provided with the packing 14 and the small diameter portion 9*b* formed with the male screw 48, while the connecting member insertion hole 26 is shaped to fit the connecting member 9 shape having those two diameter dimensions. With this configuration, when the connecting member 9 is tightened into the connecting member insertion hole 26, the female screw 47 is not disposed in a portion facing the packing 14. This can therefore ensure its effective waterproofing structure.

Also, the connecting member 9 has a hollow portion 50 which opens into the first terminal housing 5, and in this hollow portion 50 is accommodated an elastic member 15 for exerting a specified pressing force on the first isolating member 8*a*. The elastic member 15 is configured as e.g. a spring made of a metal (e.g. SUS, or the like). Incidentally, in this embodiment, the elastic member 15 comprises a portion of the connecting member 9.

An upper surface of the first isolating member 8*a* to be in contact with a portion of the elastic member 15 is formed with a recessed portion 16 which covers (accommodates) the portion of the elastic member 15. A bottom of the recessed portion 16 (i.e. its base to be in contact with the portion of the elastic member 15) is provided with a receiving member 17 made of a metal (e.g. SUS, or the like) which receives the elastic member 15 and which is for preventing damage to the first isolating member 8*a* formed of a non-conductive resin.

The receiving member 17 prevents damage to the first isolating member 8*a* by dispersing the stress exerted on the upper surface of the first isolating member 8*a* by the elastic member 15. It is therefore preferred to make the contact area between the receiving member 17 and the first isolating member 8*a* as large as possible. In this embodiment, to enlarge the contact area between the receiving member 17 and the first isolating member 8*a*, the receiving member 17 shaped as contacting the entire surface of the bottom of the recessed portion 16 is provided.

This connecting member 9 is inserted into the first terminal housing 5 from above the first joining terminal 4*a* to 4*c* surfaces (in FIG. 3, upper surfaces) to which are fixed the first isolating members 8*a* to 8*c*, respectively. The male screw 48 formed in the small diameter portion 9*b* is then screwed into the female screw 47 formed in the connecting member insertion hole 26, thereby allowing the connecting member 9 to press the plural first joining terminals 4*a* to 4*c* and the plural second joining terminals 6*a* to 6*c* in the connecting member 9 inserting direction (in FIG. 3, downward from above), and collectively fix the plural first joining terminals 4*a* to 4*c* and the plural second joining terminals 6*a* to 6*c* at the contacts therebetween, for electrical connections between the plural first joining terminals 4*a* to 4*c* and the plural second joining terminals 6*a* to 6*c*, respectively.

First Terminal Housing 5

The first terminal housing 5 is formed of a cylindrical hollow body 20 having a substantially rectangular transverse cross section. An outer portion at one end (in the figure, at the right end) of the cylindrical body 20 mated with the second terminal housing 7 is formed in a tapered shape, taking the mateability with the second connector portion 3 into consideration. Also, in the outer portion at one end of the cylindrical body 20 is provided a terminal housing waterproofing structure 21 for sealing between the first connector portion 2 and the second connector portion 3. The terminal housing waterproofing structure 21 is formed of a recessed portion 22 formed in an outer portion at the open end of the cylindrical body 20, and a packing 23 provided in the recessed portion 22, such as an O-ring.

In the other end (in the figure, in the left end) of the cylindrical body 20 is accommodated the first inner housing 10 with the first joining terminals 4*a* to 4*c* aligned and held therewith. In an outer portion at the other end of the cylindrical body 20 is formed a flange 24 for fixing the first connector portion 2 to a device chassis (e.g. a motor shield case). At an edge 25 of the flange 24 having attachment holes 24*a* (see FIG. 1) for bolt insertion and fixation to the device chassis may be provided a packing for sealing between the first connector portion 2 and the device chassis. Incidentally, this flange 24 structure is not assumed to fix the first connector portion 2 to the device chassis, but the flange 24 may be provided for the second connector portion 3, or for both the first connector portion 2 and the second connector portion 3. Also, both of the first connector portion 2 and the second connector portion 3 may be free or not fixed to the device chassis.

Also, this flange 24 is effective in enhancing heat dissipation. That is, the formation of the flange 24 permits an enlarged surface area of the first terminal housing 5, thereby allowing the enhancement in the heat dissipation to outside via the first terminal housing 5, of heat produced inside the first connector portion 2 (e.g. heat produced at each contact).

In an upper portion (in the figure, in the upper side) of the cylindrical body 20 is formed a connecting member insertion hole 26 for inserting the connecting member 9. The connecting member insertion hole 26 is formed in a cylindrical shape, and diametrically reduced at a lower end (in the figure, at the lower side) of that cylindrical shape, to fit onto the shape of the connecting member 9. This diametrically reduced portion of the connecting member insertion hole 26 is contacted with a rim of the lower surface of the large diameter portion 9*a* of the connecting member 9, thereby regulating the stroke of the connecting member 9.

For shielding performance, heat dissipation, and weight reduction of the connector 1, the cylindrical body 20 is formed of, preferably a high electrical conductivity, high thermal conductivity and lightweight metal such as an aluminum, but may be formed of a resin, or the like. When the first terminal housing 5 is formed of a non-conductive resin, the second isolating member 8*d* and the first terminal housing 5 may integrally be molded out of the non-conductive resin. Incidentally, in this embodiment, the cylindrical body 20 is formed of aluminum. The cylindrical body 20 formed of aluminum in this manner allows the connecting member 9 to be firmly tightened into the connecting member insertion hole 26 when screwed thereinto, in comparison with the cylindrical body 20 being formed of a non-conductive resin.

In this embodiment, to reduce the size of the connector 1, the clearance between the stacked structure and the first terminal housing 5 is designed to be as small as possible. Therefore, in order to prevent the first joining terminals 4*a* to 4*c* from being electrically shorted with each other via the metallic first terminal housing 5, it is necessary to ensure the insulation between the first terminal housing 5 and the first joining terminals 4*a* to 4*c*.

To that end, in this embodiment, electrical shield plates 51 are provided on both sides respectively of the first inner housing 10 aligning and holding the first joining terminals 4*a* to 4*c*. These electrical shield plates 51 are molded integrally with the first inner housing 10.

Besides having the effect of ensuring the insulation, the electrical shield plates 51 also serve as touch protection to prevent a foreign body such as a user's hand, finger or the like from contacting the side surfaces of the first joining terminals 4*a* to 4*c*. That is, when the clearance between the stacked structure and the first terminal housing 5 is configured to have such a small size that the hand or finger does not enter, the electrical shield plates 51 have the effect of ensuring the insulation between the first terminal housing 5 and the first joining terminals 4*a* to 4*c*, and when the clearance between the stacked structure and the first terminal housing 5 is configured to have such a large size that the hand or finger enters, the electrical shield plates 51 have the effect of preventing the hand or finger from contacting the side surfaces of the first joining terminals 4*a* to 4*c* when unmated, though also having the slight effect of ensuring the insulation.

Also, the electrical shield plates 51 may be replaced with the isolating members 8*a* to 8*c* also formed to cover the side surfaces of the first joining terminals 4*a* to 4*c*.

Incidentally, the proportion of adult men in workers, who manipulate the connector, is considered to be great. In this embodiment, the size of the worker's hand or finger is based on a size of an adult man's hand or finger. It should be noted, however, that this basis should naturally be altered appropriately according to the worker to be assumed.

Second Connector Portion 3

Figure 6:
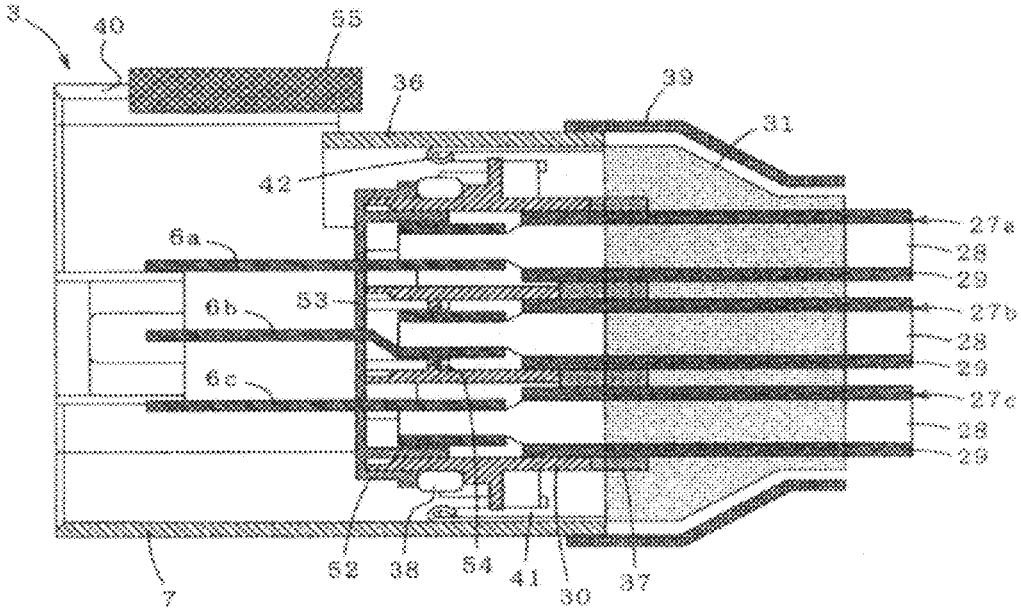
FIG. 6 is a cross sectional view showing a second connector portion.

Referring to FIG. 6, the second connector portion 3 has the second terminal housing 7 with a plurality of (three) second joining terminals (female terminals) 6*a* to 6*c* aligned and accommodated therein. Incidentally, herein, the female terminal side connector portion is referred to as the second connector portion 3. That is, the second terminal housing 7 may be either of a male terminal housing, or a female terminal housing. Herein, the second terminal housing 7 is described as the female terminal housing, in correspondence to the first terminal housing 5 that is the male terminal housing.

Second Joining Terminals 6*a* to 6*c*

Figure 7A:
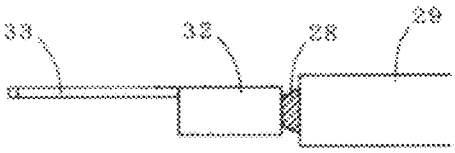
FIGS. 7A and 7B are a side view and a bottom view, respectively, showing a second joining terminal.
Figure 7B:
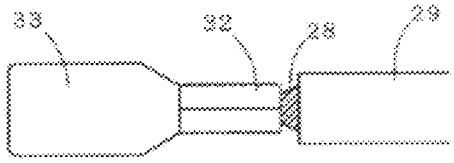
Figure 8A:
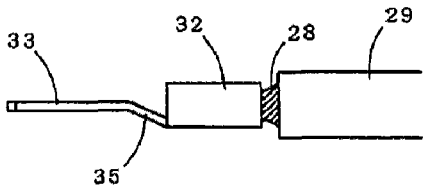
FIGS. 8A and 8B are a side view and a top view, respectively, showing a second joining terminal.
Figure 8B:
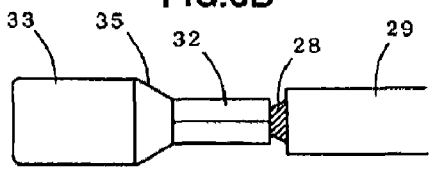

Referring to FIGS. 7 and 8, the second joining terminals 6*a* to 6*c* include calking portions 32 for calking the conductors 28 exposed from the tips of the cables 27*a* to 27*c* respectively, and plate contacts 33 formed integrally with the calking portions 32 respectively. The tips of the plate contacts 33 may be formed in a tapered shape to enhance the insertability thereof.

In this embodiment, to reduce the size of the connector 1, the cables 27*a* to 27*c* are configured to be aligned and held as close to each other as possible. To this end, as shown in FIG. 8, a trunk 35 of the second joining terminal 6*b* to be connected to the cable 27*b* arranged in the middle when aligned is bent, thereby spacing apart and aligning the second joining terminals 6*a* to 6*c* at the same pitch.

The second joining terminals 6*a* to 6*c* may each be constructed of a high electrical conductivity metal such as silver, copper, aluminum, or the like, in order to reduce the loss of power transmitted through the connector 1. Also, the second joining terminals 6*a* to 6*c* each have slight flexibility.

The second joining terminals 6*a* to 6*c* are connected with cables 27*a* to 27*c*, respectively, at one end, which extend from an inverter. These cables 27*a* to 27*c* are electrically connected to the first joining terminals 4*a* to 4*c* via the second joining terminals 6*a* to 6*c*, respectively, and therefore fed with electricity at voltages and/or currents in correspondence to the first joining terminals 4*a* to 4*c*, respectively. The cables 27*a* to 27*c* are constructed by forming an insulating layer 29 around a conductor 28. In this embodiment, the conductor 28 used has a cross section of 20 $mm^2$.

Each of the cables 27*a* to 27*c* is held by a multi-cylindrical cable holding member 30. The cable holding member 30 is formed of a non-conductive resin, to isolate the second joining terminals 6*a* to 6*c* from each other to prevent a short circuit. This cable holding member 30 allows the second joining terminals 6*a* to 6*c* to be held at predetermined positions respectively, even when the cables 27*a* to 27*c* connected to the second joining terminals 6*a* to 6*c* respectively have excellent flexibility. That is, in this embodiment, the cables 27*a* to 27*c* used can have excellent flexibility, and it is therefore possible to enhance a degree of freedom of wiring the cables 27*a* to 27*c*.

A fore end in the mating direction of the cable holding member 30 is mated with a second inner housing 52 comprising a molded resin body by which the second joining terminals 6*a* to 6*c* connected to the cables 27*a* to 27*c* respectively are held to be spaced apart from each other and aligned at a predetermined pitch. This second inner housing 52 allows the second joining terminals 6*a* to 6*c* to be positioned and held beneath the facing first joining terminals 4*a* to 4*c*, respectively, to be paired (i.e. connected) therewith, when the first connector portion 2 and the second connector portion 3 are mated together.

A method to hold the second joining terminals 6*a* to 6*c* to the second inner housing 52 may, in the same way as holding the first joining terminals 4*a* to 4*c* to the first inner housing 10, use the holding method by insertion molding.

However, because unlike the first joining terminals 4*a* to 4*c*, the second joining terminals 6*a* to 6*c* are being connected to the long cables 27*a* to 27*c* respectively, employing the insertion molding method to pre-hold the second joining terminals 6*a* to 6*c* to the second inner housing 52 requires that, when mating the second inner housing 52 to the cable holding member 30, the cable holding member 30 has to be inserted from the rear ends of the cables 27*a* to 27*c*. This is inconvenient.

For that, in this embodiment, the fore ends of the cables 27*a* to 27*c* are inserted and held in the cable holding member 30, and subsequently the second inner housing 52 having been molded into a cap shape is mated to the cable holding member 30, while the second joining terminals 6*a* to 6*c* are covered with the second inner housing 52, thereby being aligned and held thereto.

Also, the second inner housing 52 is formed with a claw 53 to be engaged with the cable holding member 30. After the second inner housing 52 being mated to the cable holding member 30 and by the claw 53 being engaged with an engaging portion 54 formed in the cable holding member 30, the second inner housing 52 is fixed to the cable holding member 30.

Also, cables 27*a* to 27*c* portions drawn out of the second terminal housing 7 are wrapped with a braided shield 31 therearound, for the purpose of enhancement in shielding performance. This braided shield 31 is contacted with a later described cylindrical shield body 41, and electrically connected via the cylindrical shield body 41 to the first terminal housing 5 (an equipotential (GND)).

Second Terminal Housing 7

Figure 9:
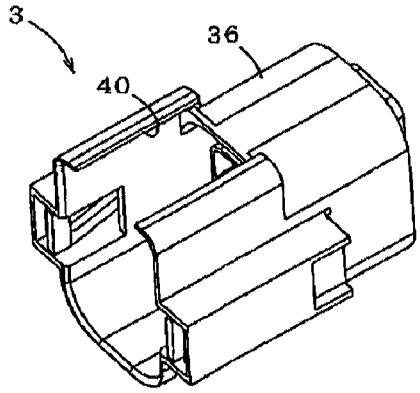
FIG. 9 is a perspective view showing a second terminal housing.

Referring to FIG. 9, the second terminal housing 7 comprises a cylindrical hollow body 36 which is substantially rectangular in transverse cross section. To mate the first terminal housing 5 into the second terminal housing 7, an inner portion at one end (in the figure, at the left end) of the cylindrical body 36 mated with the first terminal housing 5 is formed in a tapered shape, taking the mateability with the first terminal housing 5 into consideration.

Incidentally, conversely, the second terminal housing 7 may be configured as being mated into the first terminal housing 5. In this case, an inner portion at one end of the cylindrical body 20 constituting the first terminal housing 5 may be formed in a tapered shape, while an outer portion at one end of the cylindrical body 36 constituting the second terminal housing 7 may be formed in a tapered shape, and the outer portion at one end of the cylindrical body 36 may be provided with the terminal housing waterproofing structure 21.

Referring again to FIG. 6, in the other end (in the figure, in the right end) of the cylindrical body 36 is accommodated the cable holding member 30 with the cables 27*a* to 27*c* aligned and held thereto. At the cable insertion side of the cable holding member 30 is formed a packingless sealing portion 37, to prevent water from penetrating onto the cables 27*a* to 27*c* and into the second terminal housing 7. In an outer portion of the cable holding member 30 and between the cable holding member 30 and the second inner housing 52 is provided a packing 38 to be in contact with an inner surface of the first terminal housing 5. That is, the connector 1 is structured to be doubly waterproofed by the packing 23 of the terminal housing waterproofing structure 21 and the packing 38 provided in the outer portion of the cable holding member 30.

Further, an outer portion at the other end of the cylindrical body 36 from which the cables 27*a* to 27*c* are drawn out is covered with a rubber boot 39 to prevent water from penetrating into the cylindrical body 36.

Also, in an upper portion (in the figure, in the upper side) of the cylindrical body 36 is formed a connecting member manipulation hole 40 for, when the first connector portion 2 and the second connector portion 3 are mated together, manipulating the connecting member 9 provided in the first connector portion 2. This connecting member manipulation hole 40 also serves as a through hole for, after the first terminal housing 5 and the second terminal housing 7 are mated together, permitting the connecting member 9 to be inserted into or removed out of the first terminal housing 5. By serving as this through hole, the connecting member manipulation hole 40 has the convenience effect of being able to facilitate the assembly or maintenance of the connector 1. For example, even when the packing 14 provided around the connecting member 9 unavoidably needs replacement due to corrosion occurring with time, the packing 14 can be repaired or replaced by extracting the connecting member 9 from the connecting member manipulation hole 40, even without detaching the second connector portion 3 from the first connector portion 2.

Covering Member 55

Figure 10:
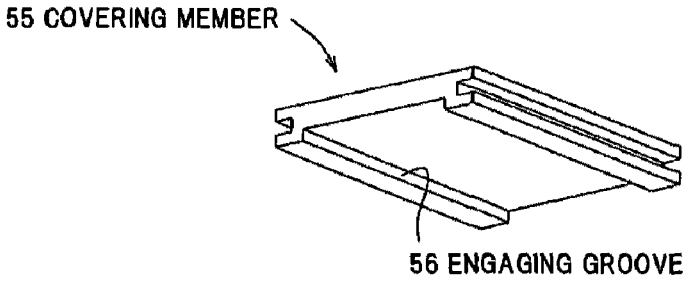
FIG. 10 is a perspective view showing a covering member.

The connecting member manipulation hole 40 is provided with a covering member 55 as shown in FIG. 10, slidably to cover the connecting member 9, to maintain the pressing force of the pressed connecting member 9 at a specified or greater pressing force that assures the stable connections between the first joining terminals 4*a* to 4*c* and the second joining terminals 6*a* to 6*c*, respectively.

This covering member 55 prevents the connecting member 9 from slipping off the first terminal housing 5, even if the tightening of the connecting member 9 loosens due to vibration. That is, when the tightening of the connecting member 9 loosens, the connecting member 9 rises in the direction of slipping off the first terminal housing 5, but the covering member 55 suppresses this rise, and can thereby maintain the pressing force of the connecting member 9 at the above mentioned specified or greater pressing force.

Also, the covering member 55 is formed with an engaging groove 56 to be engaged onto the head 9*c* shaped into the polygon having the even number of sides of the connecting member 9, so that, by the connecting member 9 being covered with the covering member 55, the head 9*c* of the connecting member 9 and the engaging groove 56 of the covering member 55 are engaged with each other, to prevent the rotation of the connecting member 9. This can prevent the loosening of the connecting member 9, which is the cause of the lowering of the pressing force.

Further, the covering member 55 is provided in such a manner that it is not slidable to cover the connecting member 9 until the pressing force of the connecting member 9 reaches the pressing force that assures the stable connections between the first joining terminals 4*a* to 4*c* and the second joining terminals 6*a* to 6*c*, respectively. That is, because as described above, the covering member 55 is configured to prevent the loosening and rising of the connecting member 9, when the connecting member 9 is not, to some extent, tightened and pressed into the first terminal housing 5 (i.e. the pressing force of the connecting member 9 does not reach the specified or greater pressing force), the lower surface of the covering member 55 is positioned to be lower than the upper surface of the connecting member 9, and therefore the covering member 55 cannot slide by contact with the connecting member 9. For that, the worker can, by the covering member 55 being slidable or not, know whether the connecting member 9 has been completely (fully) tightened or not (i.e. whether the pressing force of the connecting member 9 has reached the specified or greater pressing force or not).

In this manner, the covering member 55 has both the function of preventing the loosening of the connecting member 9 to maintain the pressing force of the connecting member 9 at the specified or greater pressing force, and the function of detecting the incomplete tightening of the connecting member 9 to detect whether the tightening of the connecting member 9 is complete or not.

The covering member 55 may be formed of a visible light transparent, or opaque material, depending on circumstances. In such a circumstance as to give precedence to the convenience of the worker, the covering member 55 is configured to be transparent, thereby allowing the worker to recognize the shape of the odd shaped hole 49 of the connecting member 9, and therefore select the tightening tool, without sliding the covering member 55, even when the connecting member 9 is being covered with the covering member 55. Also, in such a circumstance as to allow the connector 1 to be touched by an unspecified number of people, the covering member 55 is configured to be opaque, thereby allowing the unspecified number of people to be unable to recognize the shape of the odd shaped hole 49 of the connecting member 9 covered with the covering member 55, and therefore be prevented from doing mischief to the connector 1.

For shielding performance, heat dissipation, and weight reduction of the connector 1, the cylindrical body 36 is formed of, preferably a high electrical conductivity, high thermal conductivity and lightweight metal such as an aluminum, but may be formed of a resin, or the like. In this embodiment, the cylindrical body 36 is formed of a non-conductive resin. Therefore, to enhance its shielding performance and heat dissipation, an inner surface at the other end of the cylindrical body 36 is provided with a cylindrical shield body 41 made of aluminum.

The cylindrical shield body 41 has a contact 42 to be contacted with an outer portion of the first terminal housing 5 made of an aluminum when the first connector portion 2 and the second connector portion 3 are mated together. The cylindrical shield body 41 is thermally and electrically connected with the first terminal housing 5 via this contact 42. This enhances the shielding performance and the heat dissipation. In particular, the heat dissipation is likely to be significantly enhanced by positively allowing heat to escape toward the first terminal housing 5 having an excellent heat dissipation property.

Connection Between the First Joining Terminals 4*a* to 4*c* and the Second Joining Terminals 6*a* to 6*c*

Next is described the connection between the first joining terminals 4*a* to 4*c* and the second joining terminals 6*a* to 6*c* using the connector 1 in this embodiment.

When the first connector portion 2 and the second connector portion 3 are mated together, the second joining terminals 6*a* to 6*c* are inserted between the first joining terminal 4*a* with the isolating member 8*a* and the isolating member 8*b*, between the first joining terminal 4*b* with the isolating member 8*b* and the isolating member 8*c*, and between the first joining terminal 4*c* with the isolating member 8*c* and the isolating member 8*d*, respectively, where the first joining terminals 4*a* to 4*c* are to be paired with the second joining terminals 6*a* to 6*c* respectively. That insertion then allows the plural first joining terminals 4*a* to 4*c* and the plural second joining terminals 6*a* to 6*c* to face each other to form pairs, respectively, at one surface thereof, and result in a stacked structure comprising the first joining terminals 4*a*, 4*b*, and 4*c* and the second joining terminals 6*a*, 6*b*, and 6*c* alternately disposed therein, and further alternately interleaved with the isolating members 8*a* to 8*d*.

At this point, inside the first connector portion 2, the isolating members 8*a* to 8*c* are respectively fixed to the tips of the first joining terminals 4*a* to 4*c* held to be spaced apart from each other and aligned at a specified pitch. A pitch between the isolating members 8*a*, 8*b* and 8*c* can therefore be held, even without separately providing a holding jig for holding the pitch between the isolating members 8*a*, 8*b* and 8*c*. This allows the second joining terminals 6*a* to 6*c* to be easily inserted between the first joining terminal 4*a* with the isolating member 8*a* and the isolating member 8*b*, between the first joining terminal 4*b* with the isolating member 8*b* and the isolating member 8*c*, and between the first joining terminal 4*c* with the isolating member 8*c* and the isolating member 8*d*, respectively, where the first joining terminals 4*a* to 4*c* are paired with the second joining terminals 6*a* to 6*c* respectively. That is, the insertability/removability of the second joining terminals 6*a* to 6*c* is not likely to deteriorate. Also, because of no need to provide a holding jig for holding the pitch between the isolating members 8*a*, 8*b* and 8*c*, further size reduction can very effectively be achieved, in comparison to the prior art.

Also, the contact between the first joining terminal 4*a* (or 4*b*) and the second joining terminal 6*a* (or 6*b*) is sandwiched between the first isolating member 8*a* (or 8*b*) fixed to the first joining terminal 4*a* (or 4*b*) constituting the contact, and the first isolating member 8*b* (or 8*c*) fixed to the first joining terminal 4*b* (or 4*c*) constituting the other contact. Likewise, the contact between the first joining terminal 4*c* and the second joining terminal 6*c* is sandwiched between the first isolating member 8*c* fixed to the first joining terminal 4*c* constituting the contact, and the second isolating member 8*d* fixed to the inner surface of the first terminal housing 5.

Referring again to FIG. 2, following that, the connecting member 9 is manipulated from the connecting member manipulation hole 40, to screw and tighten the male screw 48 of the connecting member 9 into the female screw 47 of the connecting member insertion hole 26. The connecting member 9 is then rotated and pressed into the first terminal housing 5, and causes the elastic member 15 to, in turn, press the first isolating member 8*a*, the first isolating member 8*b*, the first isolating member 8*c*, and the second isolating member 8*d*, and sandwich the contacts between the isolating members 8*a* and 8*b*, between the isolating members 8*b* and 8*c*, and between the isolating members 8*c* and 8*d*, respectively, with the contacts isolated from each other. At this point, by being pressed by the isolating members 8*a* to 8*d*, the first joining terminals 4*a* to 4*c* and the second joining terminals 6*a* to 6*c* are slightly bent and contacted with each other, respectively, in a wide range. This allows each of the contacts to be firmly contacted and fixed, even in a vibrational environment such as on a vehicle. This allows the realization of the connector being especially effective on a vehicle which tends to cause vibration.

Figure 11:
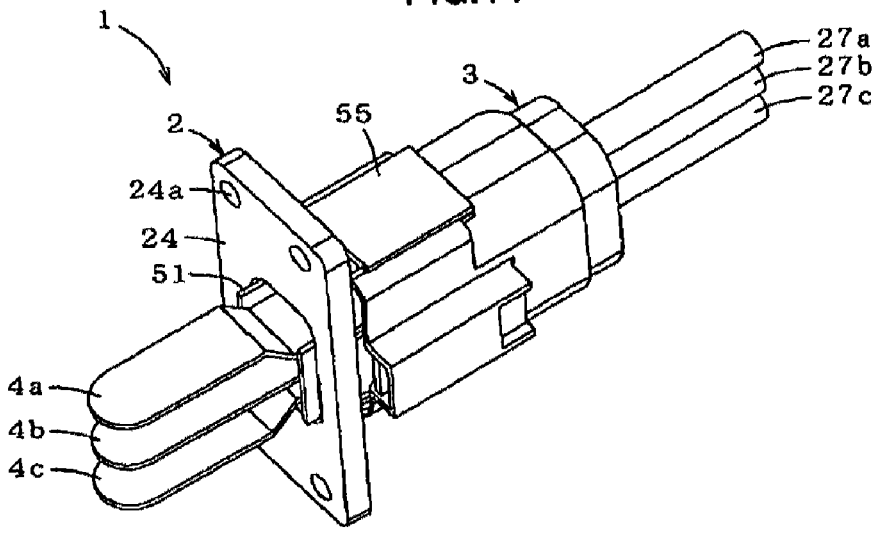
FIG. 11 is a perspective view showing operation of the connector in one embodiment according to the invention.

Finally, referring to FIG. 11, the covering member 55 is slid to cover the connecting member 9, to prevent the loosening of the connecting member 9, and to detect the incomplete tightening of the connecting member 9. When the covering member 55 is permitted to be slid, the connection between the first joining terminals 4*a* to 4*c* and the second joining terminals 6*a* to 6*c* is completed. When the covering member 55 is not permitted to be slid, the connecting member 9 is further tightened.

Effects of the Embodiment

Thus, the connector 1 in this embodiment is provided with the covering member 55 having both the function of preventing the loosening of the connecting member 9 to maintain the pressing force of the connecting member 9 at the specified or greater pressing force, and the function of detecting the incomplete tightening of the connecting member 9 to detect whether the tightening of the connecting member 9 is complete or not. It is therefore possible to suppress the decrease in the pressing force at the contacts due to vibration and to easily detect whether the tightening of the connecting member 9 is complete or not.

The invention is not limited to the above embodiment, but various alterations may be made without departing from the spirit and scope of the invention.

Modifications

Figure 12:
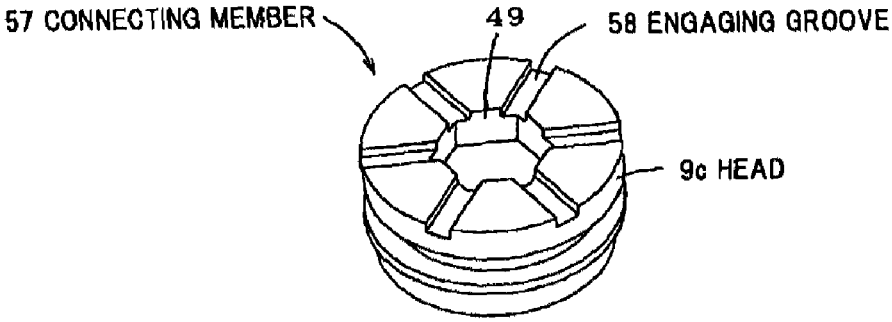
FIG. 12 is a view showing a modification to the connecting member.
Figure 13:
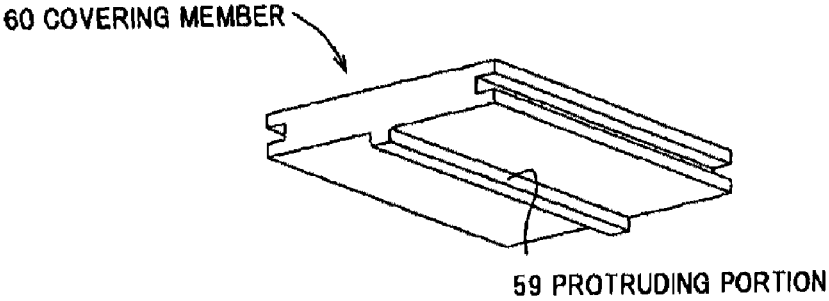
FIG. 13 is a view showing a modification to the covering member.
Figure 14:
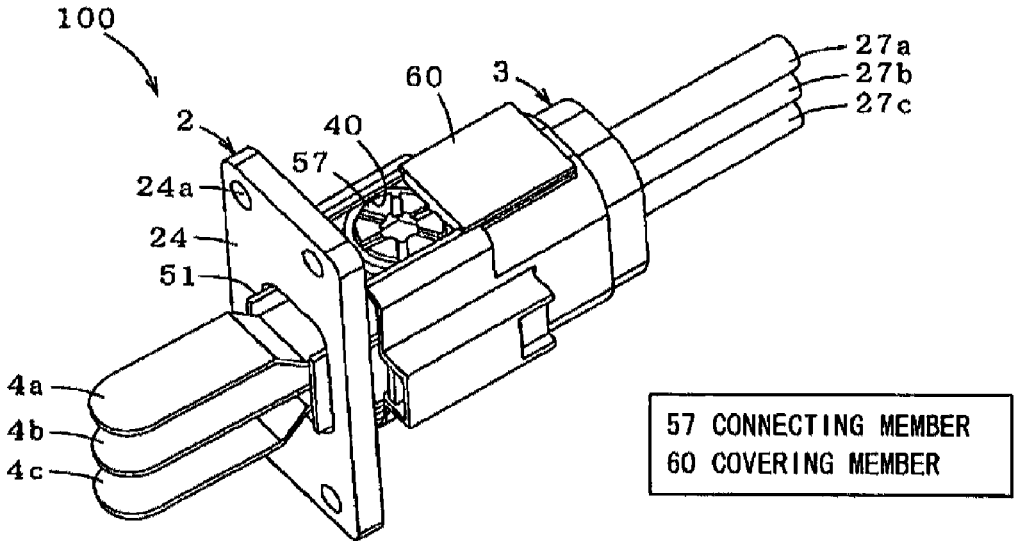
FIG. 14 is a view showing a modification to the connector.

For example, although in this embodiment, the connecting member 9 whose head 9*c* is formed in the polygonal shape having the even number of sides has been used, a connecting member 57 having its head 9*c* formed in any other shape (e.g. a circular shape) as shown in FIG. 12 may be used. In this case, an upper surface of the head 9*c* may be formed with an engaging groove 58, and there may, as shown in FIG. 13, be used a covering member 60 formed with a protruding portion 59 to be engaged into the engaging groove 58 in its sliding direction, to prevent the rotation of the connecting member 57. This structure is applied to a connector 100 as shown in FIG. 14. This connector 100 of FIG. 14 also makes it possible to suppress the decrease in the pressing force at its contacts due to vibration, and to easily detect whether the tightening of the connecting member 57 is complete or not.

Figure 15:
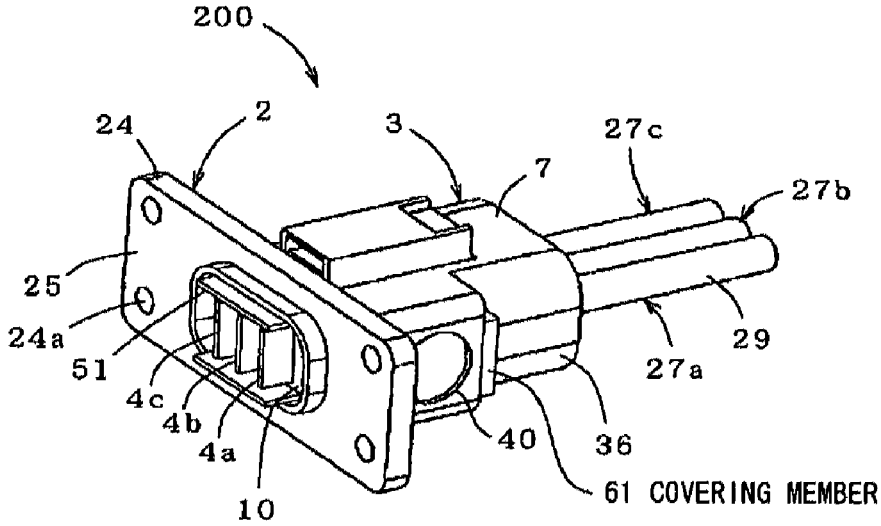
FIG. 15 is a perspective view showing the connector in the modification to the invention.
Figure 16:
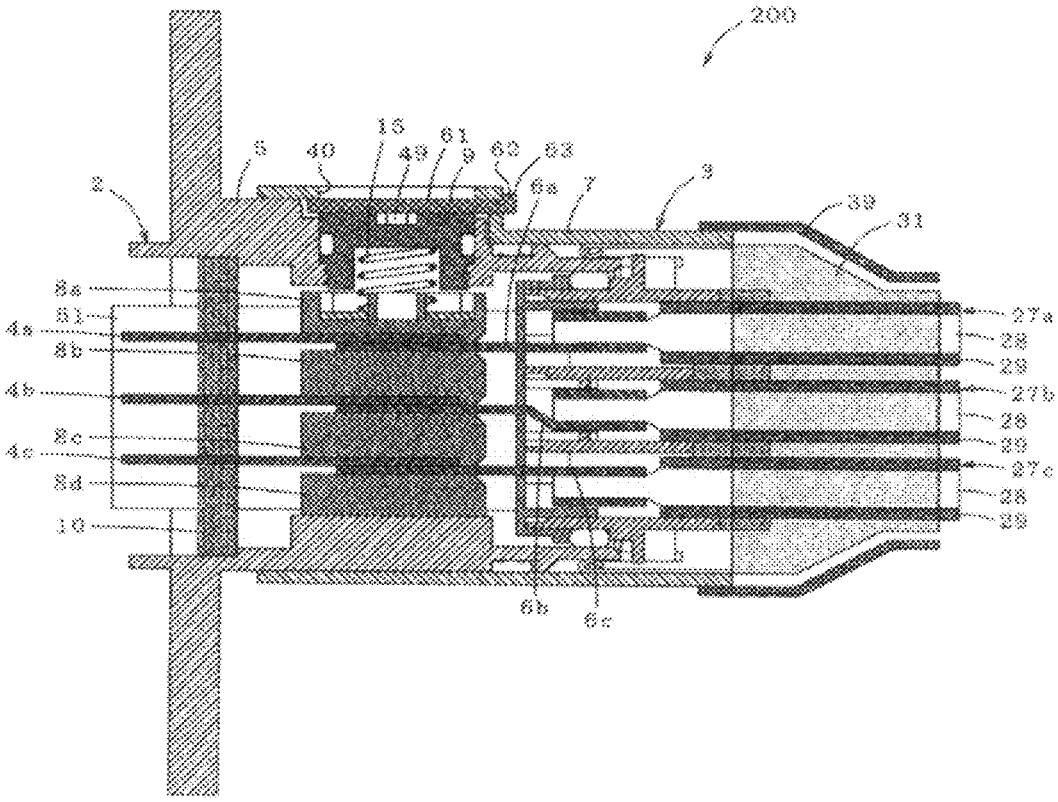
FIG. 16 is a cross sectional view showing the connector in the modification to the invention.

Also, although in this embodiment, the connecting member manipulation hole 40 has been formed to be communicated with the opening in one end side of the cylindrical body 36, it may be not communicated therewith. In this case, there may, as shown in FIGS. 15 and 16, be provided a covering member 61, which is slidably inserted to fill the gap between the second terminal housing 7 and the pressed connecting member 9. This covering member 61 is inserted from a covering member insertion hole 62 formed for the second terminal housing 7. The rear end in the sliding direction of the covering member 61 is formed with a handle 63 to regulate its sliding, so as not to permit the entire covering member 61 to fit in the second terminal housing 7. The connector 200 as shown in FIGS. 15 and 16, to which the foregoing structure is applied, also makes it possible to suppress the decrease in the pressing force at its contacts due to vibration, and to easily detect whether the tightening of the connecting member 57 is complete or not.

Also, although in this embodiment, three phase alternating power lines have been assumed, according to the technical idea of the invention, the connector for a vehicle, for example, may be configured to collectively connect lines for different uses, such as three phase alternating current power lines for between a motor and an inverter, two phase direct current power lines for an air conditioner, and the like. Such configuration allows the power lines for the plurality of uses to be collectively connected by one connector. There is therefore no need to prepare a different connector for each use, and it is thereby possible to contribute to space saving or cost lowering.

Also, although in this embodiment, the first joining terminals 4*a* to 4*c* and the second joining terminals 6*a* to 6*c* have been in surface contact with each other respectively, the first joining terminal 4*a* to 4*c* contact side surfaces to be contacted with the second joining terminals 6*a* to 6*c* may be configured to be formed with protruding portions respectively, and the plate contacts 33 of the second joining terminals 6*a* to 6*c* may be configured to be fitted onto these protruding portions, respectively. Such configuration allows the further stabilization of the coupling forces between the first joining terminals 4*a* to 4*c* and the second joining terminals 6*a* to 6*c*, respectively. That is, this configuration is especially effective for vibration perpendicular to the connecting member 9.

Also, although in this embodiment, when viewed from the large diameter portion 9*a* side of the connecting member 9, the first joining terminals 4*a* to 4*c* and the second joining terminals 6*a* to 6*c* have been configured to be linearly contacted with each other respectively, the first terminal housing 5 and the second terminal housing 7 may be configured so that, when viewed from the large diameter portion 9*a* side of the connecting member 9, the first joining terminals 4*a* to 4*c* of the first connector portion 2 cross and contact the second joining terminals 6*a* to 6*c* respectively of the second connector portion 3 at a right angle thereto. That is, the first connector portion 2 and the second connector portion 3 may be mated with each other in an L shape. Likewise, the second terminal housing 7 and the second joining terminals 6*a* to 6*c* may be configured to be disposed obliquely relative to the first terminal housing 5 and the first joining terminals 4*a* to 4*c* respectively. By thus applying the gist of the invention, the direction of inserting/removing the second connector portion 3 relative to the first connector portion 2 can be varied. That is, the direction of drawing the cables out from the connector 1 can be fitted to a desired direction, and it is thereby possible to contribute to space saving.

Also, the terminal surfaces of the first joining terminals 4*a* to 4*c* and the second joining terminals 6*a* to 6*c* may be knurled to make their frictional force large, so that the terminals are thereby unlikely to move relative to each other, and are firmly fixed at the contacts therebetween respectively.

Also, although in this embodiment it has been described that, unlike the second joining terminals 6*a* to 6*c*, the first joining terminals 4*a* to 4*c* are not connected with cables respectively at one end, the first joining terminals 4*a* to 4*c* are not limited to this structure. That is, the connector 1 in this embodiment may also be employed when connecting cables together.

Also, although in this embodiment, the cables 27*a* to 27*c* used have excellent flexibility, rigid cables may be used.

Also, in this embodiment, the connecting member 9 used has the odd shaped hole 49 formed in the upper surface of its large diameter portion 9*a*, and into which is mated the hexagonal wrench (also called hexagonal spanner). This hexagonal wrench has been assumed to use a commercial hexagonal wrench, but may be assumed to use an uncommercial shape exclusive tool, and the connecting member 9 may be configured so that the upper surface of its large diameter portion 9*a* is formed with the odd shaped hole 49 shaped to fit that exclusive tool.

Also, in this embodiment, the use orientation of the connector 1 is such that the connecting member 9 may be substantially horizontal or substantially vertical. In other words, the use conditions of the connector 1 in this embodiment require no use orientation.

Also, although in this embodiment, the connecting member 9 has been pressed to the adjacent first isolating member 8*a* via the elastic member 15 comprising a portion of the connecting member 9, the connecting member 9 may be pressed directly to the adjacent first isolating member 8*a*, not via the elastic member 15.

Also, although in this embodiment, the screw structure to screw the connecting member 9 to the first terminal housing 5 has been formed by forming the female screw 47 in the inner surface of the connecting member insertion hole 26 of the first terminal housing 5 while forming in the outer surface of the small diameter portion 9*b* of the connecting member 9 the male screw 48 which screws to the female screw 47, there may be employed any other structure to press the connecting member 9 into the first terminal housing 5 and thereby press the adjacent first isolating member 8*a*. For example, a cam structure to engage a cam and a cam groove together and thereby press the connecting member 9 into the first terminal housing 5 may be formed by forming the cam in the inner surface of the connecting member insertion hole 26 while forming in the outer surface of the small diameter portion 9*b* of the connecting member 9 the cam groove which engages the cam.

Also, because the pressing force of the connecting member 9 can be maintained by the covering member 55 suppressing the rise of the connecting member 9, the connecting member 9 may not screw or engage to the first terminal housing 5. It should be noted, however, that, from the point of view of reliability, such a structure as to screw or engage the connecting member 9 to the first terminal housing 5 is preferred.

Incidentally, the invention may also be applied to a connector having a penetrating connecting member, which penetrates the plural first joining terminals 4*a* to 4*c*, the plural second joining terminals 6*a* to 6*c*, and the plural isolating members 8*a* to 8*d*, terminates in and screws to a female screw formed in the first terminal housing 5. It should be noted, however, that the use of the non-penetrating connecting member 9 can ensure cost reduction in comparison to the use of the penetrating connecting member 9, and further the employing of the non-penetrating connecting member 9 can lead to weight reduction of the connecting member 9, resulting in a contribution to weight reduction of the entire connector 1 as well.

Also, in this embodiment, as shown in FIG. 2, the plural isolating members 8*a* to 8*c* have been configured to be integrally fixed to the upper surfaces of the first joining terminals 4*a* to 4*c* respectively, and the uppermost isolating member 8*a* adjacent to the connecting member 9 has been configured to be pressed by the connecting member 9, more specifically, by the elastic member 15 which is the connecting member 9 portion. However, this configuration, when each first joining terminal and each isolating member are managed to be one part, causes the first joining terminal 4*a* and isolating member 8*a* part to be shaped differently from the other parts (i.e. the first joining terminal 4*b* and isolating member 8*b* part, and the first joining terminal 4*c* and isolating member 8*c* part). This results in not only inconvenience in managing the parts, but also an increase in the number of production steps, in view of insertion molding of each first joining terminal and each isolating member.

Accordingly, as a solution to this problem, there is considered a stacked structure formed by, in FIG. 2, integrally fixing the plural isolating members 8*a* to 8*c* to the lower surfaces of the plural first joining terminals 4*a* to 4*c* respectively, and mating the first connector portion 2 and the second connector portion 3 together so that the plural second joining terminals 6*a* to 6*c* face the upper surfaces of the first joining terminals 4*a* to 4*c* respectively. This configuration allows the isolating members 8*a* to 8*c* to be identically shaped. The above mentioned problem is therefore solved. Incidentally, in the case of this configuration, the elastic member 15 which is the connecting member 9 portion directly presses the uppermost second joining terminal 6*a*, but when the elastic member 15 is metallic, the elastic member 15 needs to be not contacted directly with the second joining terminal 6*a*. As its specific example, a tip of the elastic member 15 may be covered with an insulating cap to comprise a portion of the connecting member 9.

Also, although in this embodiment the isolating members 8*a* to 8*c* have been shown as being fixed to the other surfaces of the plural first joining terminals 4*a* to 4*c* respectively, and this embodiment is most effective in view of the vibration problem due to use on a vehicle, the plural isolating members 8*a* to 8*c* may be not fixed to the other surfaces of the plural first joining terminals 4*a* to 4*c* respectively, but configured to be held by a holding jig provided separately, as in JP Patent No. 4037199. Even in application to this configuration, the invention can achieve its advantageous effect.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A connector, comprising:

a first terminal housing with a plurality of first joining terminals aligned and accommodated therein;

a second terminal housing with a plurality of second joining terminals aligned and accommodated therein;

a stacked connection structure that, when the first terminal housing and the second terminal housing are mated together, the plural first connecting terminals and the plural second connecting terminals face each other to form pairs, respectively, and the isolating plates, the first connecting terminals and the second connecting terminals are disposed alternately;

a plurality of isolating members aligned and accommodated in the first terminal housing, the plural isolating members being disposed on other surfaces of the plural first joining terminals, respectively;

a connecting member for pressing and thereby collectively fixing the plural first joining terminals and the plural second joining terminals at the contacts therebetween respectively, to electrically connect the first joining terminals and the second joining terminals, respectively; and a covering member slidably provided to cover the connecting member, to maintain the pressing force of the pressed connecting member at a specified or greater pressing force that assures the stable connections between the first joining terminals and the second joining terminals, respectively, the covering member being provided in such a manner that it is not slidable to cover the connecting member until the pressing force of the connecting member reaches the pressing force that assures the stable connections between the first joining terminals and the second joining terminals, respectively.

2. The connector according to claim 1, wherein the connecting member comprises a head shaped into a polygon having an even number of sides, and the covering member comprises an engaging groove which is engaged onto the head of the connecting member.

3. The connector according to claim 1, wherein the covering member comprises a protruding portion in a sliding direction thereof, and the connecting member comprises an engaging groove into which the protruding portion is engaged.

4. The connector according to claim 1, wherein the first terminal housing is a male terminal housing, the second terminal housing is a female terminal housing, and the covering member is slidably inserted to fill the gap between the second terminal housing and the pressed connecting member.

5. The connector according to claim 1, wherein the covering member comprises a visible light transparent material.

6. The connector according to claim 1, wherein the covering member comprises a visible light opaque material.

* * * * *